United States Patent [19]

Stolarczyk et al.

[11] Patent Number: 4,507,654

[45] Date of Patent: Mar. 26, 1985

[54] SECURITY SYSTEM WITH INFRARED OPTICAL POSITION DETECTOR

[75] Inventors: Larry G. Stolarczyk; John R. Owerko, both of Raton, N. Mex.

[73] Assignee: A. R. F. Products, Raton, N. Mex.

[21] Appl. No.: 316,868

[22] Filed: Oct. 30, 1981

[51] Int. Cl.[3] ..... G08B 13/08

[52] U.S. Cl. ..... 340/545; 340/556; 340/600

[58] Field of Search ..... 340/556, 555, 557, 545, 340/546, 600

[56] References Cited

U.S. PATENT DOCUMENTS

| | | | |
|---|---|---|---|
| 3,544,988 | 12/1970 | Astheimer | 340/600 |
| 3,703,718 | 11/1972 | Berman | 340/567 |
| 3,727,207 | 4/1973 | Missio et al. | 340/557 |
| 3,839,640 | 10/1974 | Rossin | 250/353 |
| 3,928,843 | 12/1975 | Sprout et al. | 340/587 |
| 3,967,258 | 6/1976 | Bucy, Jr. | 340/556 |
| 4,068,222 | 1/1978 | Treviranus | 340/556 |
| 4,092,636 | 5/1978 | Shepherd, Jr. | 340/545 |
| 4,195,234 | 3/1980 | Berman | 307/117 |
| 4,207,466 | 6/1980 | Drage et al. | 340/556 |
| 4,250,498 | 2/1981 | Walter | 340/556 |
| 4,258,259 | 3/1981 | Obara et al. | 250/338 |
| 4,258,260 | 3/1981 | Obara et al. | 250/338 |

OTHER PUBLICATIONS

Johnson, A. R., "Proximity Sensor Technology for Manipulator End Effectors", *Mechanism & Machinery Theory,* vol. XII, pp. 95–109, Pergamon Press, Great Britain, 1977.

*Primary Examiner*—Glen R. Swann, III

*Attorney, Agent, or Firm*—Burmeister, York, Palmatier, Hamby & Jones

[57] ABSTRACT

A security device for determining the opening or closed condition of an access gate, such as a door or window hinged within an opening in a wall, has a detector unit mounted on the wall adjacent to the opening and linked to a remote control unit by a radio transmitter in the detection unit and a radio receiver in the control unit. The detection unit has an infrared generator and an infrared detector isolated from the generator, the detector and generator confronting a reflector mounted on the access gate when the access gate is closed. The reflector is translated from the field of the infrared generator when the access gate is open. The infrared generator is excited by a pulse generator to produce pulses of infrared radiation, and the scattered radiation from the reflector is detected by the infrared detector to produce electrical pulses coincident with the pulse generator. A coincidence circuit determines the presence of the detected pulse, and the absence of coincidence results in the transmission of a radio wave from the detector unit to the control unit to establish alarm conditions.

8 Claims, 10 Drawing Figures

72A
OUT
ALOG
9V
GND
NC
33K
33K
128
122
126
124A
GØ
104A
DØ
9V
GND

60
TARGET
112
C1
74
FILTER
72
22K
R12
92
C3
470K
R8
470K
R9
50K
R10
C4
C2
100K
R11
114
94
110
68Ω
R3
CR1
36
Q1
108
1K
R1
100K
R2
34
Q2
106
47K
R4
120
Q4
100K
R5
47K
R6
Q3
118
47K
R7
116
104
DØ
D2
124
GØ/SI
GND
9V
GND

SECURITY SYSTEM WITH INFRARED OPTICAL POSITION DETECTOR

BACKGROUND OF THE INVENTION

The present invention relates to security systems with devices for detecting the location of an object between one and a plurality of different locations. More specifically, the present invention relates to security systems with infrared devices for detecting an open door or window, and to wireless security systems utilizing such devices.

Security systems presently known to the art detect open doors or windows in a number of ways. Hard wire systems generally utilize magnetic switches having mating parts mounted on and adjacent to a door or window which separate when the door is open, thereby actuating the alarm. Such hard wire systems require careful installation and are costly to install. Another type of device for detecting the opening of a door is an ultrasonic unit in which ultrasonic energy is made to impinge upon the door and the reflected energy utilized to indicate a closed door condition. Ultrasonic systems have been sensitive to temperature changes and external noise, and often have been difficult to install so as to avoid false triggering. Infrared detectors have been utilized to detect the presence of a warm body passing through an open door, or a change in temperature caused by the opening of a door. The presence of ambient light or heat have tended to make such systems unreliable.

DESCRIPTION OF PRIOR ART

Infrared intrusion systems have been known to the art for a considerable period of time. Herbert L. Berman obtained U.S. Pat. No. 3,703,718 entitled INFRARED INTRUSTION DETECTOR SYSTEM on Nov. 21, 1972. This patent discloses a passive infrared detector in that it detects the change in infrared radiation in an area caused by the presence of an intruder and attempts to focus this radiation and isolate it from background energy. U.S. Pat. No. 3,839,640 of John A. Rossin entitled DIFFERENTIAL PYROELECTRIC SENSOR was granted on Oct. 1, 1974 to another type of passive infrared detector which utilizes a differential type detecting unit.

A further improvement in such passive infrared detectors is disclosed in U.S. Pat. No. 3,928,843 of James Cole Sprout and Herbert L. Berman entitled DUAL CHANNEL INFRARED INTRUSION ALARM SYSTEM granted Dec. 23, 1975. Herbert L. Berman further developed passive infrared detectors as disclosed in U.S. Pat. No. 4,195,234 entitled INFRARED INTRUSION ALARM SYSTEM WITH TEMPERATURE RESPONSIVE THRESHOLD LEVEL dated Mar. 25, 1980. Also, improvements in infrared detectors as such are disclosed in U.S. Pat. No. 4,258,259 of Hiroshi Obara and Tetuaki Kon entitled INFRARED DETECTOR dated Mar. 24, 1981 and U.S. Pat. No. 4,258,260 of Hiroshi Obara; Tetuaki Kon; and Naohiro Murayama entitled PYROELECTRIC INFRARED DETECTOR of the same date.

Infrared energy has also been utilized in other types of transducers. A. R. Johnston published a paper entitled Proximity Sensor Technology From Manipulator End Effects in Mechanism and Machinery Theory, 1977, Volume 12, pages 95 through 109, Pergamon Press, Great Britain, in which a pulsed infrared LED source was utilized in connection with an optical system and an array of infrared detectors for a proximity sensor for use with a remotely actuated manipulator.

The present invention provides an improved detection means for determining whether a door or window is open or closed. A pulsed source of infrared is directed on a reflective surface associated with the door or window and the scatter radiation from the reflective surface is detected by an infrared responsive cell. Pulse signals from the cell are utilized only when such pulses occur coincidentally with pulses of infrared radiation to achieve greater reliability. When this construction is combined with a radio frequency transmitter in a single unit, installation of the unit becomes merely a matter of placement with respect to the door or window, and hence the construction is very advantageous for wireless security systems.

DESCRIPTION OF PREFERRED EMBODIMENT

Figure 1:
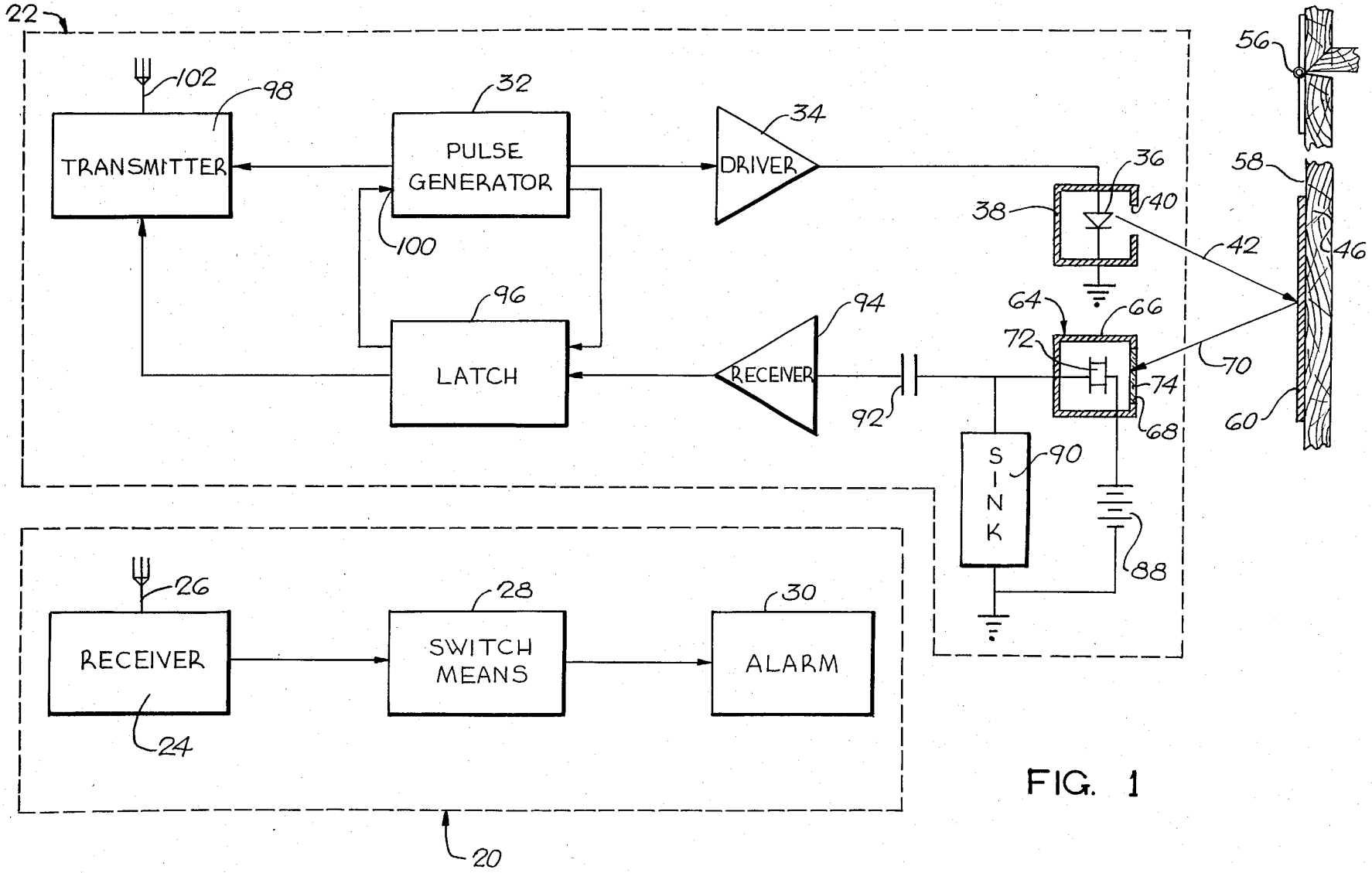
FIG. 1 is a block diagram of a security system constructed according to the teachings of the present invention, FIG. 1 illustrating schematically a hinged closure operatively associated with the security system.

As illustrated in the figures, a security device according to the present invention consists of a control unit 20 and a transmitter unit 22. The control unit 20 has a receiver 24 with an antenna 26 and is adapted to receive radio frequency signals from the transmitter unit 22. The receiver 24 is connected to switch means 28, and the switch means is electrically connected to an alarm 30. When the receiver 24 receives a radio frequency signal from the transmitter unit 22, the receiver will actuate the switch means 28, causing the alarm 30 to be actuated. Rather than an audible device, the alarm may be a nonaudible notification means to personnel to investigate the security breach thus reported. The alarm 30 contemplates the use of telephone lines with a dialer system, a private telephone line to a control station, or a coaxial cable to a control station, as well as lights, bells, sirens, and the like. Further, the receiver 24 may be provided with means to distinguish between signals received from the transmitter, and actuate the switch means 28 only responsive to an intrusion, or the detection of a fire, or the like.

The transmitter unit has a pulse generator 32 which produces a chain of substantially square wave pulses, and these pulses are impressed upon a driver 34 which is electrically connected to an infrared light emitting diode 36. Responsive to each pulse of the generator 32, the diode 36 emits infrared radiation. The diode 36 is disposed within an enclosure 38 provided with an aperture 40 in order to produce a beam 42 of infrared radiation.

Figure 2:
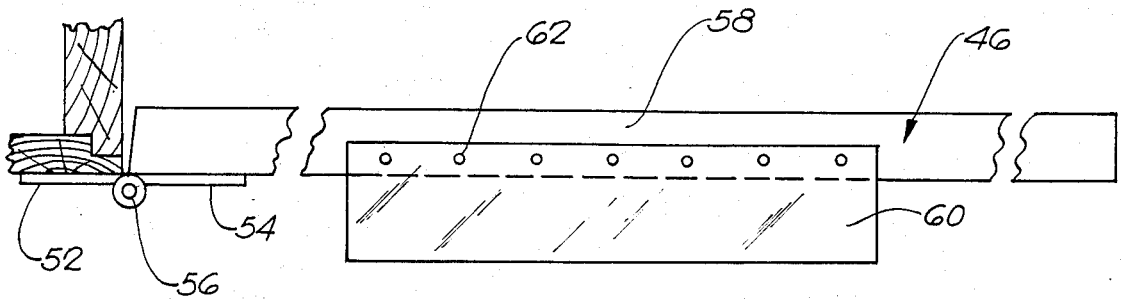
FIG. 2 is a sectional view of the hinged closure taken along the line 2—2 of FIG. 3.
Figure 3:
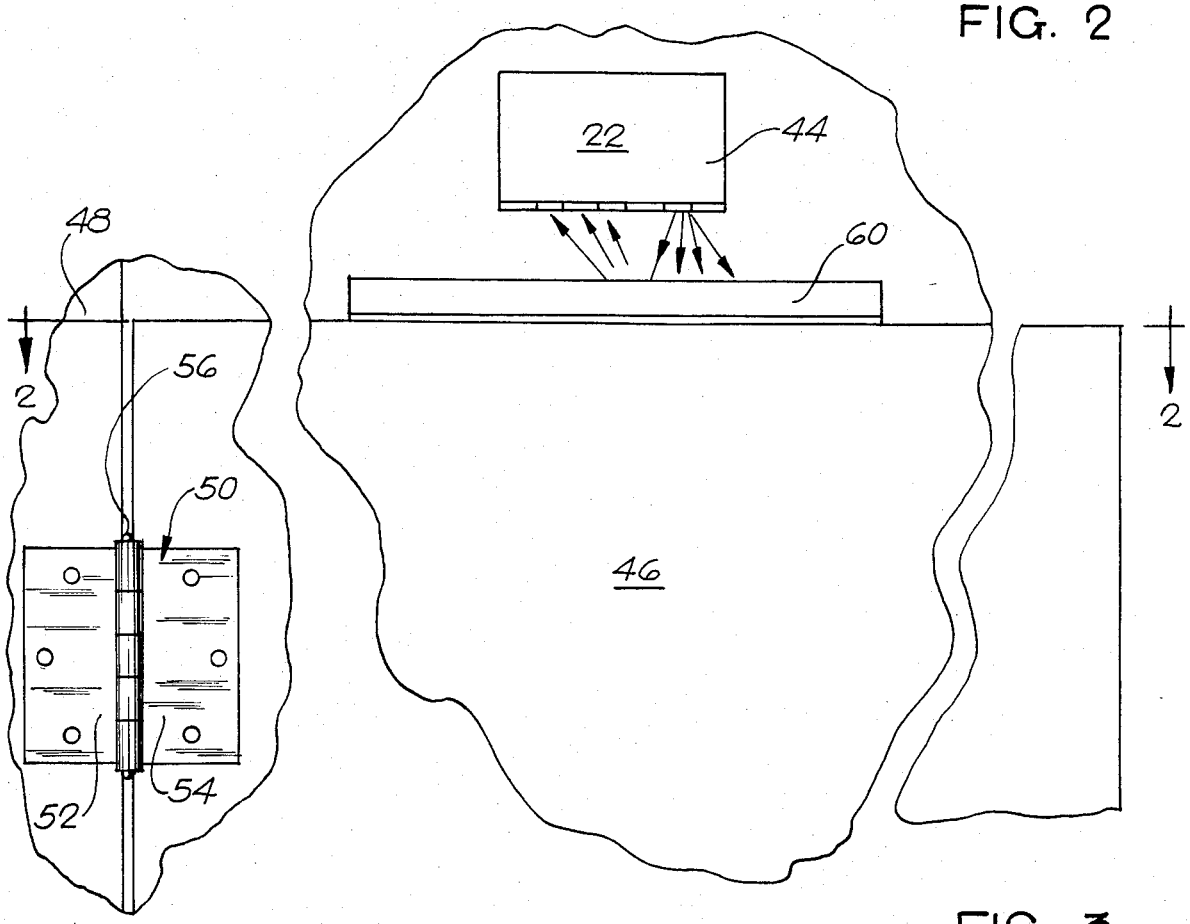
FIG. 3 is a vertical elevational view of the security system of FIG. 1 in association with the hinged closure.

FIG. 3 illustrates the transmitter unit 22 disposed within a casing 44 and mounted directly above a wall closure 46, such as a door or window. The wall closure 46 is pivotally mounted on the wall 48 of a structure by means of a hinge 50 with leaves 52 and 54 mounted on the wall and wall closure, respectively, the leaves 52 and 54 being interconnected by a pin 56. The top 58 of the wall closure 46 is provided with a flat reflector 60 which may be a sheet of reflective metal which protrudes from the wall closure 46, or may be a layer of reflective tape mounted on the surface of the top 58 of the wall closure. As illustrated in FIGS. 2 and 3, the reflector 60 is a metal sheet secured to the top 58 of the wall closure by pins 62, although adhesive could also be employed.

The transmitter unit also has an infrared detector 64 which contains an enclosure 66 provided with an aperture 68. The aperture 68 also confronts the reflector 60, and the enclosure is positioned within the casing 44 of the transmitter unit to receive scattered radiation from the reflector 60, that scattered radiation generally following the path of the beam 70. An infrared responsive cell 72 is disposed within the enclosure 66 of the detector 64. The aperture 68 in the enclosure 66 is closed by a filter plate 74 which is generally transparent to infrared radiation but opaque to light radiation of other frequencies, thereby minimizing the effect of the ambient light on the response of the cell 72. Gel filters have been found to be suitable for such uses.

The infrared responsive cell is preferably a photo diode responsive to infrared radiation. This cell is generally used in a smoke detector, but functions in the present application. Such photo diodes are responsive over relatively short ranges, of the order of ten to twenty inches, and hence the cell 72 must be placed at a distance no greater than twenty inches from the light reflecting surface, and preferably at a distance of from two to six inches. Since the photo diode is not sensitive over a long range, a person walking through a door such as the closure 46, will not be close enough to the photo diode to cause false triggering.

Figure 4:
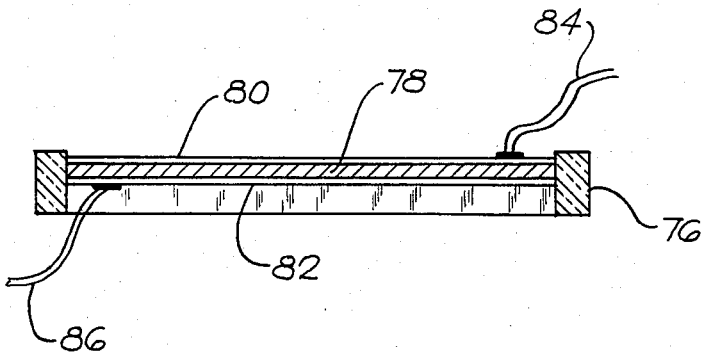
FIG. 4 is a transverse sectional view of the infrared sensitive cell diagramatically illustrated in FIG. 1.

Much greater range can be achieved with a cell of the type illustrated in FIG. 4. This cell utilizes a hollow cylindrical segment to form a collar 76 which supports a film 78 of polyvinylidene fluoride (PVF 2 polymer), the film being stretched tightly across the collar 76. The film 78 carries a thin layer 80 on one surface and a second thin layer 82 on the opposite surface, the layers 80 and 82 made of nickel with a thickness of about 100 UM and deposited by evaporation techniques. The layers 80 and 82 constitute electrodes for conductors 84 and 86. This type of infrared detector is capable of functioning over greater distances and responds to the infrared radiation of a body coming within its range. The infrared responsive cell of FIG. 4 is suitable for use as the cell 72 in the circuit of FIG. 1.

The cell 72 is connected in a series circuit with a DC source 88 and a resistor or sink 90. Radiation impinging upon the cell 72 will result in the flow of current through this circuit developing a potential across the sink 90, and since the beam 42 of infrared energy impinging upon the reflector 60 is a pulsed source, the potential developed in response to scattered radiation from that beam will appear across the sink 90 as a chain of pulses. These pulses are passed through a capacitor 92 to an amplifier or receiver 94. A latch circuit 96 is electrically connected between the receiver 94 and a transmitter 98. A pulse from the receiver 94 could be used to actuate the transmitter 98 in an intermittant fashion, that is, cause the transmitter to transmit only during periods in which the pulse is present. In the particular embodiment, the transmitter 98 is amplitude modulated by the pulse from the latch 96. The transmitter is actuated directly by a pulse from the pulse generator 32 so that the transmitter is in the "on" condition during all periods in which the infrared source is generating radiation.

The pulse generator 32 is designed to produce a pulse of no more than one second duration at least every thirty seconds. This pulse is impressed upon the latch circuit 96, and no signal will be passed from the latch circuit 96 to the transmitter 98 unless it is coincident with the pulse from the pulse generator 32. As a result, infrared energy impinging upon the cell 72 during periods between pulses from the pulse generator 32 will not be conducted to the transmitter 98 and result in false alarms. Further, the output of the latch 96 is connected to a terminal 100 of the pulse generator 32 to cause the pulse generator to speed up its frequency in order to confirm the occurrence of an event which requires an alarm, and the pulse generator 32 will repeat its pulses every two seconds during periods in which a signal from the latch 96 appears on the terminal 100. The transmitter 98 is coupled to the receiver 24 by radio frequency signals transmitted through an antenna 102.

In the embodiments set forth in FIG. 1, the infrared responsive cell 72 receives pulses of scatter radiation 70 during all periods in which the wall closure 46 is in closed condition. The latch 96, however, is responsive to the absence of coincidence between the pulses from the receiver and the pulses from the pulse generator to amplitude modulate the transmitter 98 and to latch the pulse generator 32. Accordingly, the transmitter unit 22 reports the condition of the door closure 46 as being open, but makes no response when the door closure 46 is closed.

The latch 96 may also be connected to pass pulses from the receiver 94 directly to the transmitter if coincidence with pulses from the pulse generator 32 occurs. In that case, the reflector 60 must be totally hidden in the opening of the wall 48 for the wall closure 46, as is the case of an adhesive reflective strip attached to the top 58 of the wall closure 42.

It will be recognized that the control unit 20 may be placed in a convenient position within a structure, substantially out of sight, and that the control unit may have the convenience features available in security systems known to the art. For example, the control unit may be placed at a telephone line terminal and provide communication to an external control room in response to signals from the transmitter unit 22. At the same time, the transmitter unit may be self contained, utilizing a battery power source, and positioned directly above, or at the side of, any wall closure desired without the use of interconnecting wires. The transmitter unit 22 may itself be secured to the wall 48 by means of an adhesive strip, and since the scatter radiation from the reflector will not require critical adjustment of the diode 36 with respect to the infrared responsive cell 72, the installation itself becomes simple and noncritical.

Figures 6, 7:
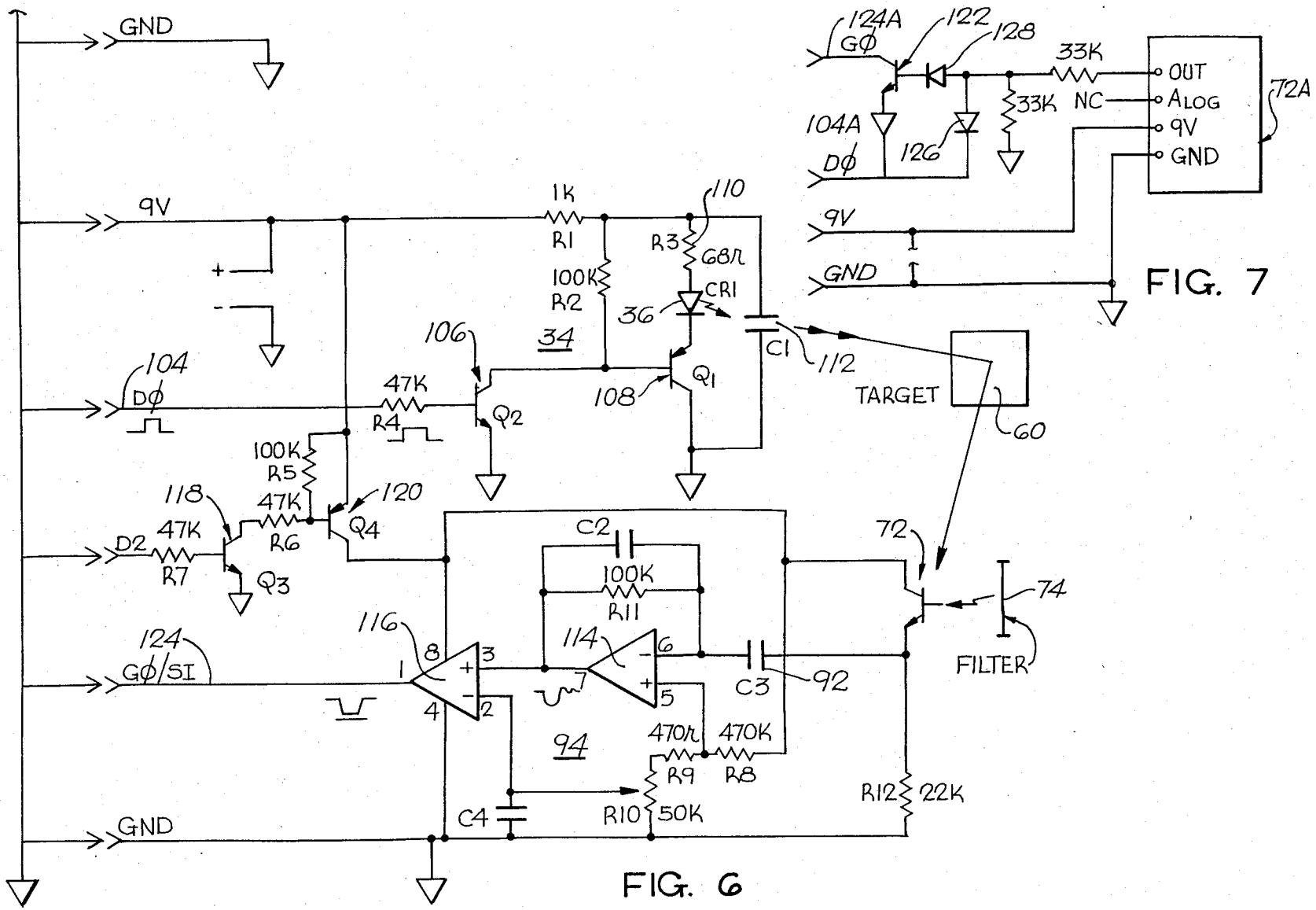
FIG. 6 is a fragmentary schematic electrical circuit diagram of a portion of the transmitter module illustrated in FIG. 1.
FIG. 7 is an electrical circuit diagram illustrating another type of infrared detector which may be utilized with the other elements of the transmitter unit of FIG. 1.

FIG. 6 illustrates the electrical circuits for the light emitting diode 36 and driver 34, and the electrical circuits for the infrared responsive cell 72 and receiver 94. The square wave pulse from the pulse generator 32 is transmitted through terminal 104 to a transistor inverter 106. The inverted pulse is impressed upon a switch having a transistor 108 with a base-emitter circuit connected in a series circuit with the infrared emitting diode 36, a resistor 110, and a direct current power source, said series combination being bridged by a capacitor 112. The resistor 110 and capacitor 112 provide a proper time constant to discharge the diode 36 upon opening of the transistor switch 108.

The scattered radiation from the reflector 60 passes through the gel filter 74 to the infrared sensitive diode 72. The output of the cell 72 is transmitted through the condensor 92 to two amplifiers 114 and 116 connected in cascade. The output of the amplifier 116 is in the form of a substantially square wave pulse, and it is transmitted to the transmitter 98 to amplitude modulate the transmitter.

The pulse generator 32 impresses a pulse through the transistor amplifier 118 to the transistor switch 120. The transistor switch is thus closed during periods of pulses from the pulse generator 32 to provide DC power for the amplifiers 114 and 116, thereby producing an output on the amplifier 116 only during the critical time periods.

FIG. 7 illustrates a passive infrared detector which may be utilized in place of the detector of FIG. 6. The output of the passive detector, such as the cell of FIG. 4, designated 72A, is transmitted through a transistor amplifier 122 to the terminal 124A. It will be noted that the terminal 124A corresponds to the output terminal of the amplifier 116, designated 124. In like manner, the circuit of FIG. 7 has a terminal 104A corresponding to the terminal 104 for receiving a pulse from the pulse generator 32. The output of the cell 72A is connected to the transistor amplifier 122 through a diode 128, and no signal will pass to the amplifier unless a signal is also present on the terminal 104A. Hence, the circuit of FIG. 7 also will not respond to infrared radiation except during periods in which a pulse is generated by the pulse generator 32.

Figure 5:
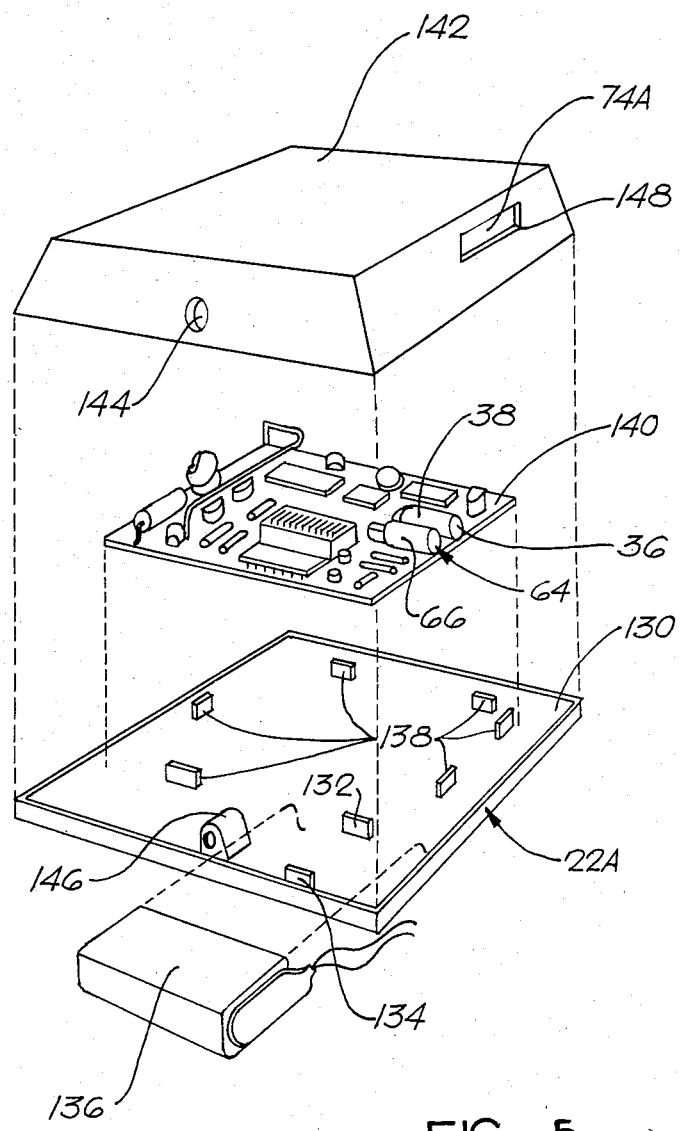
FIG. 5 is an exploded view of the transmitter assembly diagramatically illustrated in FIG. 1.

FIG. 5 is an exploded view of a particular construction of a transmitter unit 22, designated 22A. The unit is mounted on a base 130 which is provided with a pair of protruding posts 132 and 134 to accommodate a battery 136. The base is also provided with a plurality of posts 138 which are positioned to engage the perimeter of a printed circuit board 140 which contain the elements of the transmitter electronic circuits. It will be noted that the infrared emitting diode 36 is positioned on the printed circuit board 140 adjacent to the detector 64. The printed circuit board 140, with its assembled components is secured on the base 130 in engagement with the posts 138. A cover 142 is positioned over the printed circuit board 140 and battery 136 and secured in position on the base by means of a screw not shown which passes through an opening 144 in the cover to engage a threaded hub 146. The cover is also provided with a slot 148, and the slot accommodates the filter plate designated 74A.

Figure 8:
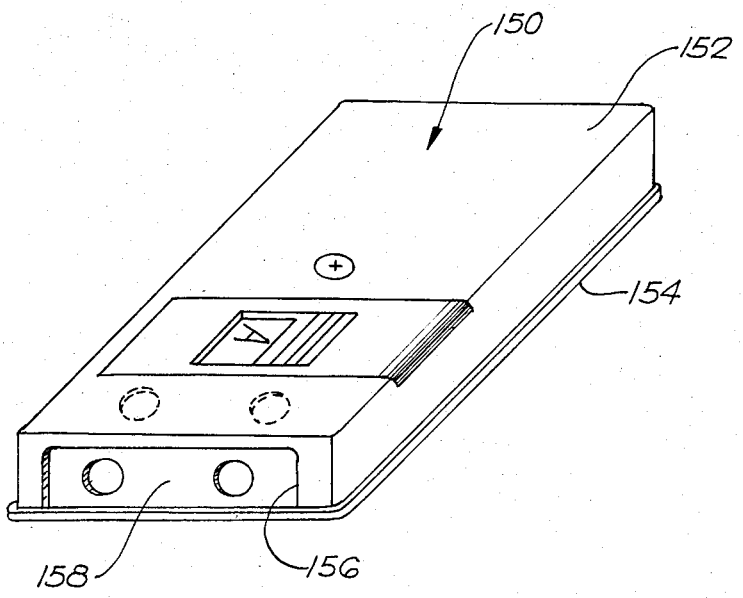
FIG. 8 is a modified physical form of the transmitter unit of FIG. 1.
Figure 9:
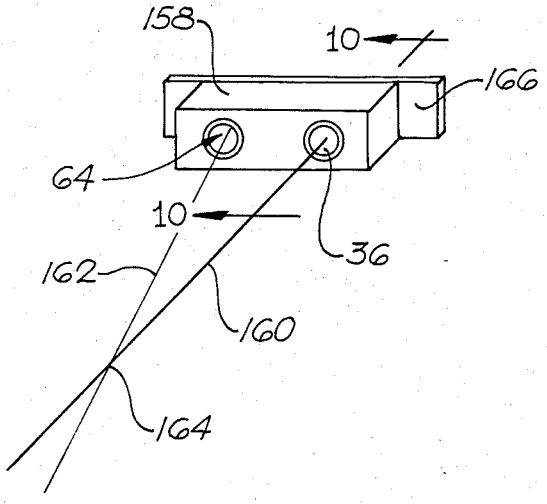
FIG. 9 is a subassembly view illustrating a portion of the transmitter unit of FIG. 1 in exploded form.
Figure 10:
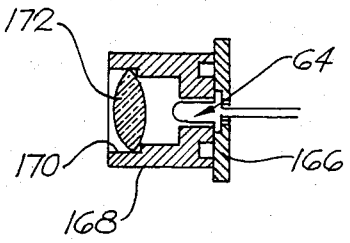
FIG. 10 is a sectional view taken along the line 10—10 of FIG. 9.

FIGS. 8 through 10 illustrate another embodiment of the transmitter unit of the present invention. In this embodiment, the electronic components and battery are housed within a casing 150 which comprises a cover 152 and a base 154. The cover is provided with a cutout 156, and an insert 158 is disposed in the cutout. The insert is shown in FIG. 9. The insert contains the light emitting diode 36 which projects a beam designated 160. The insert also contains the diode detector 64 which is provided with restrictive means to limit reception of the detector to an axis designated 162. The axis of reception 162 crosses the axis of radiation 160 at a point designated 164. In practice, this point should be approximately on the plane of the reflector 60.

Sensitive axes 160 and 162 are achieved by means of the structure illustrated in FIG. 10. FIG. 10 illustrates the detecting diode 64, mounted on a printed circuit board 166 which forms a part of the insert 158. It is to be understood that the diode 36 may be substituted for the diode 64. A shround 168 extends from the printed circuit board about the diode 64 to form a limiting aperture 170. The limiting aperture 170 will restrict the beam 160 of radiation, or the reception axis 162. Further restriction is achieved by narrowing the aperture with a double convex lens 172 which is mounted in the aperture 170.

From the foregoing disclosure, those skilled in the art will devise many uses for the present invention beyond that here disclosed. Further, those skilled in the art will devise modifications within the intended scope of the present invention. It is therefore intended that the present invention be not limited by the foregoing specification, but rather only by the appended claims.

The invention claimed is:

1. A security system responsive to the position of an access gate disposed in an opening in a wall of a building structure, said access gate being movably attached to the wall to assume an open or a closed position, comprising a means for indicating an occurrence, a control unit connected to the means for indicating an occurrence, the means for indicating an occurrence being responsive to an electrical signal from the control unit, and detection means operatively associated with the control unit, said detection means comprising a reflector mounted on the access gate and extending normally therefrom, said reflector being disposed in a first position when the access gate is in the closed position and a second position when the access gate is in the open position, a base adapted to be mounted on the wall of the building structure adjacent to the access gate, an electrical pulse generator mounted on the base, an infrared radiation generator mounted on the base and electrically connected to the pulse generator, said infrared generator being responsive to electrical pulses from the pulse generator to produce pulses of infrared radiation, said infrared generator including means for directing said infrared radiation in a beam with a central axis extending from the base to the first position of the reflector, a detector mounted on the base, said detector having an infrared radiation sensitive surface and producing an electrical signal responsive to infrared radiation, said detector having means limiting radiation reaching said infrared sensitive surface to a direction having a central axis extending toward the first position of the reflector, the second position of the reflector being off-axis with respect to the beam of the infrared generator and central axis of the detector, whereby the reflector when located in the first position is in the paths of the beams of the generator and the detector and will scatter infrared radiation from the infrared generator to the detector to produce an electrical signal, and a coincidence circuit electrically connected to the detector and the pulse generator, the control unit being operatively associated with the detector through the coincidence circuit.

2. A security system comprising the combination of claim 1 wherein the control unit includes a receiver, and a transmitter for communicating with the receiver is mounted on the base of the detection means, the transmitter being coupled to the coincidence circuit to produce a signal responsive to a pulse from the detector, whereby the detection means may be disposed remotely of the control unit.

3. A security system comprising the combination of claim 1 wherein the means for directing infrared radiation comprises a convex lens.

4. A security system comprising the combination of claim 1 wherein the means limiting radiation reaching the infrared sensitive surface of the detector comprises a convex lens.

5. A security system comprising the combination of claim 1 wherein the detector is disposed within and mounted on an enclosure, the enclosure being provided with an aperture confronting the light sensitive surface, and the aperture being closed by a light filter attenuating light rays for frequencies outside of the infrared band to a greater extent than light rays within the infrared frequency band.

6. An infrared optical detector responsive to the position of an access gate movably mounted on a wall of a structure and located in an opening in the wall comprising a reflector adapted to be mounted on the gate and having an infrared reflecting surface extending outwardly from the gate, said reflecting surface being disposed in a first position when the gate is open and a second position when the gate is closed, a base adapted to be mounted on the wall adjacent to the opening, a pulse generator mounted on the base having an output terminal, said pulse generator producing a chain of pulses spaced by time intervals on said output terminal, a diode mounted on the base and electrically connected to the output terminal of the pulse generator, said diode emitting a pulse of infrared energy in response to each pulse of the pulse generator, means operatively associated with the diode directing the infrared energy therefrom on the first position of the reflector and shielding the second position of the reflector from said infrared energy, an infrared detector mounted on the base having a shield disposed between the diode and the detector to attenuate infrared energy produced by the diode at the detector, said shield having a window for infrared energy confronting the first position of the reflector, a receiver having an output connected to the detector for receiving electrical pulses from the output of the detector and an output, a coincidence circuit havin a first and a second input and an output, the output of the receiver being connected to the first input of the coincidence circuit, the second input of the coincidence circuit being connected to the output of the pulse generator, and a transmitter having a first and a second input, the first input being electrically connected to the output of the pulse generator, said transmitter being actuated responsive to each pulse of the pulse generator impressed upon said first input, the second input of the transmitter being electrically connected to the output of the coincidence circuit, the transmitter generating one radiation signal in response to pulses on the first and second inputs thereof.

7. An infrared optical detector comprising the combination of claim 6 wherein the infrared detector and the infrared emitting diode are disposed at a distance less than twenty inches from the first position of the reflector.

8. An infrared optical detector comprising the combination of claim 6 wherein a transmitter is amplitude modulated responsive to pulses on the second input of the transmitter.

* * * * *